US008837986B2

(12) United States Patent
Seo et al.

(10) Patent No.: US 8,837,986 B2
(45) Date of Patent: Sep. 16, 2014

(54) DEVELOPING DEVICE OF IMAGE FORMING APPARATUS

(75) Inventors: Young Wok Seo, Suwon-si (KR); Ji Won Moon, Anyang-si (KR); Ho Jin Jang, Suwon-si (KR); Dong Kyu Lee, Cheonan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 218 days.

(21) Appl. No.: 13/337,641

(22) Filed: Dec. 27, 2011

(65) Prior Publication Data

US 2012/0163855 A1 Jun. 28, 2012

(30) Foreign Application Priority Data

Dec. 27, 2010 (KR) ..... 10-2010-0135438
Nov. 28, 2011 (KR) ..... 10-2011-0125224

(51) Int. Cl.
*G03G 15/08* (2006.01)
*G03G 15/20* (2006.01)
*G03G 21/00* (2006.01)

(52) U.S. Cl.
CPC ..... *G03G 15/0813* (2013.01); *G03G 21/0011* (2013.01); *G03G 15/0898* (2013.01)
USPC ..... 399/123; 399/102; 399/103; 399/105; 399/350

(58) Field of Classification Search
USPC ..... 399/102, 279, 350
See application file for complete search history.

(56) References Cited

U.S. PATENT DOCUMENTS

| | | | | |
|---|---|---|---|---|
| 4,331,754 | A * | 5/1982 | Stephan | 430/102 |
| 5,293,199 | A * | 3/1994 | Saito et al. | 399/103 |
| 5,610,690 | A * | 3/1997 | Yoshihara et al. | 399/167 |
| 2004/0081480 | A1 * | 4/2004 | Matsumaru et al. | 399/103 |
| 2005/0185980 | A1 * | 8/2005 | Okamoto | 399/103 |
| 2008/0187353 | A1 * | 8/2008 | Moon | 399/103 |
| 2009/0269106 | A1 | 10/2009 | Fujii | |
| 2010/0028045 | A1 * | 2/2010 | Kawakami et al. | 399/123 |
| 2011/0274447 | A1 * | 11/2011 | Arai et al. | 399/24 |

FOREIGN PATENT DOCUMENTS

JP 11119548 4/1994

OTHER PUBLICATIONS

European Search Report Issued on Apr. 18, 2012 in EP Patent Application No. 11195194.3.

* cited by examiner

*Primary Examiner* — David Bolduc
(74) *Attorney, Agent, or Firm* — Stanzione & Kim, LLP

(57) ABSTRACT

An image forming apparatus having an improved configuration to prevent foreign substances from accumulating on a space maintaining member used to maintain a constant distance between a photoconductor and a developer delivery member. The image forming apparatus includes a photoconductor, a developer delivery member to deliver and feed developer to the photoconductor, a cleaning member to remove the developer and foreign substances remaining on a surface of the photoconductor while coming into contact with the photoconductor, and a space maintaining member arranged to come into contact with the photoconductor so as to maintain a constant developing gap or developing nip between the photoconductor and the developer delivery member. The space maintaining member is located between both ends of the cleaning member.

10 Claims, 8 Drawing Sheets

DEVELOPING DEVICE OF IMAGE FORMING APPARATUS

CROSS-REFERENCE TO RELATED APPLICATIONS

This application claims the benefit of Korean Patent Applications No. 2010-0135438, filed on Dec. 27, 2010 and No. 2011-0125224, filed on Nov. 28, 2011 in the Korean Intellectual Property Office, the disclosure of which is incorporated herein by reference.

BACKGROUND OF THE INVENTION

1. Field of the Invention

Embodiments of the present inventive concept relate to an image forming apparatus in which a space maintaining member to maintain a constant developing nip or developing gap between a photoconductor and a developer delivery member has an improved position.

2. Description of the Related Art

An image forming apparatus is designed to form an image on a print medium according to input signals. Examples of image forming apparatuses include printers, copiers, fax machines, and devices combining functions thereof.

In an electro-photographic image forming apparatus, a photoconductor, which has been charged with a predetermined electric potential, is exposed to light such that an electrostatic latent image is formed on a surface of the photoconductor. Developer is fed to the electrostatic latent image to form a visible image and thereafter, the visible image is transferred and fused to paper, completing printing of the image on the paper.

In general, methods of arranging a developer delivery member include a contact type method in which the developer delivery member comes into contact with the photoconductor to feed developer to the photoconductor, and a non-contact type method in which the developer delivery member is spaced apart from the photoconductor by a constant distance to feed developer to the photoconductor.

In the case of the contact type method, a developing nip is defined between the photoconductor and the developer delivery member, and in the case of the non-contact type method, a developing gap is defined between the photoconductor and the developer delivery member. Both the contact type method and the non-contact type method adopt a contact member, which comes into contact with the photoconductor to maintain a constant developing nip or developing gap.

A space maintaining member is located on the same axis as the developer delivery member so as to rotate together with the developer delivery member. As the space maintaining member is rotated in contact with an outer peripheral surface of the photoconductor, a constant developing nip or developing gap between the photoconductor and the developer delivery member is maintained. However, if foreign substances accumulate and attach to the space maintaining member, the radius of the space maintaining member locally increases due to buildup of the substances, which makes it difficult to maintain a constant developing nip or developing gap between the photoconductor and the developer delivery member and results in periodic image printing defects.

SUMMARY

The present inventive concept provides an image forming apparatus having an improved configuration to prevent foreign substances from accumulating on a space maintaining member that is used to maintain a constant developing nip or developing gap between a photoconductor and a developer delivery member.

Additional features and utilities of the present inventive concept will be set forth in part in the description which follows and, in part, will be obvious from the description, or may be learned by practice of the invention.

In accordance with an exemplary embodiment, a developing device includes a photoconductor, a developer delivery member to deliver and feed developer to the photoconductor, a cleaning member to remove developer and foreign substances remaining on a surface of the photoconductor while coming into contact with the photoconductor, and space maintaining members arranged to directly or indirectly come into contact with the photoconductor so as to maintain a constant developing gap or developing nip between the photoconductor and the developer delivery member, wherein the space maintaining members are located between both ends of the cleaning member.

The developing device may further include sealing members respectively located at both ends of the cleaning member to prevent leakage of the developer, and the space maintaining members may be located between the sealing members.

Each of the sealing members may include a contact portion to come into contact with both ends of the photoconductor, and the space maintaining members may be located between the contact portions of the sealing members.

The developing device may further include auxiliary sealing members coupled to a surface of the cleaning member and arranged to come into contact with the respective sealing members so as to prevent leakage of the developer in cooperation with the sealing members.

The space maintaining members may be located between the auxiliary sealing members.

The space maintaining members may be provided at the outer side of both ends of the developer delivery member, and a distance between the space maintaining members may be greater than a width of paper delivered to the photoconductor.

Each of the space maintaining members may be spaced apart from one end of the cleaning member by a distance of about 20 mm or less.

In accordance with another exemplary embodiment, an image forming apparatus includes a main body, a housing mounted in the main body, a photoconductor rotatably coupled to the housing, a developer delivery member arranged near the photoconductor to deliver developer to the photoconductor, a cleaning blade arranged to come into contact with a surface of the photoconductor so as to remove the developer remaining on the surface of the photoconductor, sealing members arranged to come into contact with both ends of the cleaning blade so as to prevent leakage of the developer, and a space maintaining member arranged within an area to be cleaned by the cleaning blade and serving to maintain a constant developing gap or developing nip between the photoconductor and the developer delivery member.

The image forming apparatus may further include a waste developer storage chamber in which the developer removed from the surface of the photoconductor is stored, and a film member arranged below the cleaning blade to define an entrance of the waste developer storage chamber along with the cleaning blade and the sealing members.

The space maintaining member may be located inside both ends of the entrance.

Each of the sealing members may include a fixing portion fixed to one side of the housing and a contact portion to come into contact with the cleaning blade, and the space maintaining member may be located between the contact portions of the sealing members.

In accordance with another exemplary embodiment, a developing device usable with an image forming apparatus includes: a photoconductor to receive developer; a cleaning member extending along a length of the photoconductor and to remove remaining developer from the photoconductor; and a developer delivery member to deliver the developer to the photoconductor, the developer delivery member including space maintaining members disposed at each end thereof to contact respective ends of the photoconductor to maintain a space or nip between the developer delivery member and the photoconductor, the space maintaining members being disposed at positions inside a region defined by ends of the cleaning member In an embodiment, the developing device further includes sealing members disposed at each end of the cleaning member to contact respective ends of the photoconductor to absorb developer remaining at ends of the cleaning member and to prevent leakage of the developer past the ends of the cleaning member.

In an embodiment, the space maintaining members are disposed inside a region defined by the sealing members.

In an embodiment, the sealing members overlap a portion of the ends of the cleaning members.

In an embodiment, the developing device further includes a waste developer storage chamber in which the developer removed from the surface of the photoconductor is stored; and a film member disposed below the cleaning blade to define an entrance of the waste developer storage chamber along with the cleaning blade and the sealing members.

In accordance with another exemplary embodiment, an image forming apparatus includes a developer housing mounted therein, the housing comprising: a photoconductor disposed therein to receive developer; a developer delivery member to deliver developer to the photoconductor; a cleaning member disposed to contact a surface of the photoconductor to clean the surface of the photoconductor of remaining developer; and a space maintaining member disposed between the developer deliver member and the photoconductor to maintain a constant developing gap or developing nip therebetween and provided within a region in which the cleaning member cleans the surface of the photoconductor.

In an embodiment, the image forming apparatus further includes sealing members disposed within the housing at respective ends of the cleaning member to absorb developer extending past the ends of the cleaning member.

In an embodiment, the space maintaining member is disposed within a region between the sealing members.

In an embodiment, the space maintaining member comprises first and second space maintaining members disposed at opposite ends of the developer deliver member.

BRIEF DESCRIPTION OF THE DRAWINGS

These and/or other features of the inventive concept will become apparent and more readily appreciated from the following description of the embodiments, taken in conjunction with the accompanying drawings of which.

DETAILED DESCRIPTION

Figure 1:
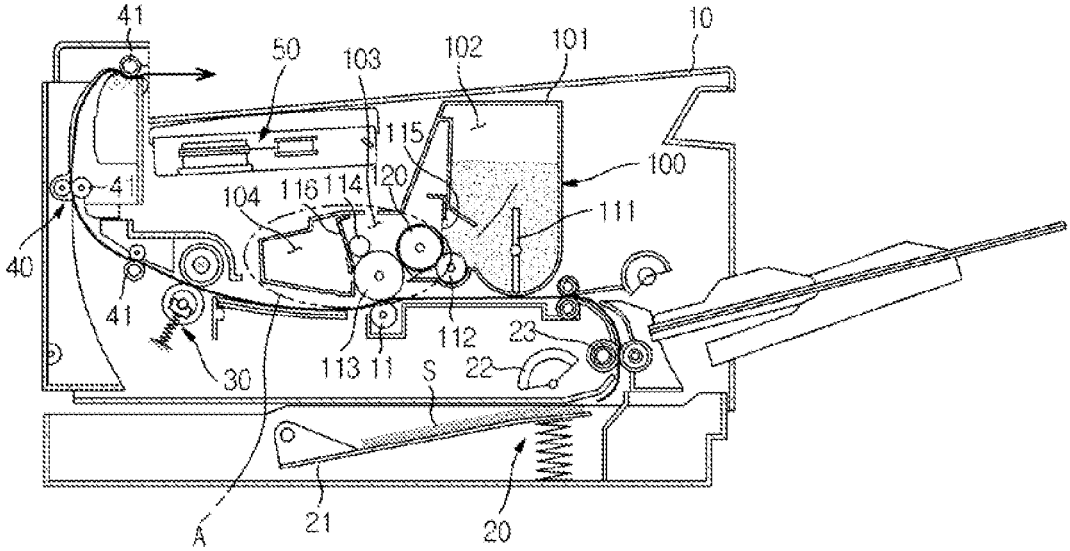
FIG. 1 is a view schematically illustrating a configuration of an image forming apparatus according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically illustrating a configuration of an image forming apparatus according to an embodiment of the present inventive concept.

As illustrated in FIG. 1, the image forming apparatus includes a main body 10, which defines an external appearance of the image forming apparatus and supports a variety of constituent elements installed in the image forming apparatus, a paper feeding device 20 to feed printing media, i.e. paper S, a developing device 100 to develop an image on the paper, a fusing device 30 to fuse the developed image on the paper by applying heat and pressure to the paper, and a paper discharge device 40 to discharge the paper, on which the image has been completely printed, to the outside of the main body 10.

The paper feeding device 20 includes a paper feeding cassette 21 in which the paper S is stored, a pickup roller 22 to pick up the paper S stored in the paper feeding cassette 21 sheet by sheet, and a delivery roller 23 to move the picked-up paper toward the developing device 100.

The developing device 100 includes a housing 101, which defines an external appearance of the developing device 100 and supports a variety of constituent elements installed in the developing device 100. The housing 101 contains a developer storage chamber 102 in which developer is stored, and a developing chamber 103 in which a developing operation is performed using the developer fed from the developer storage chamber 102.

The developer storage chamber 102 is provided with an agitating blade 111 and a feed roller 112. The agitating blade 111 serves to agitate the developer stored in the developer storage chamber 102, thereby preventing the developer from hardening. The feed roller 112 serves to feed the developer from the developer storage chamber 102 to the developing chamber 103. The feed roller 112 is rotated in contact with a developer delivery member 120 which will be described hereinafter, thereby feeding the developer to the developer delivery member 120.

The developing chamber 103 is provided with a photoconductor 113, on a surface of which an electrostatic latent image is formed by an exposure device 50 based on image information. The developing chamber 102 is further provided with a charging roller 114 to charge the surface of the photoconductor 113 with a predetermined electric potential. The developer delivery member 120 is installed in the developing chamber 103 and serves to deliver the developer fed by the feed roller 112 to the photoconductor 113 so as to develop the electrostatic latent image formed on the photoconductor 113 to a visible image. The developer delivery member 120 is rotatably supported at opposite lateral surfaces of the housing 101 using a rotating shaft (120*a*, see FIG. 2).

A regulating member 115 is installed in the housing 101. The regulating member 115 serves to regulate the thickness of a developer layer when the developer is adhered to a surface of the developer delivery member 120 by the feed roller 112.

Figure 2:
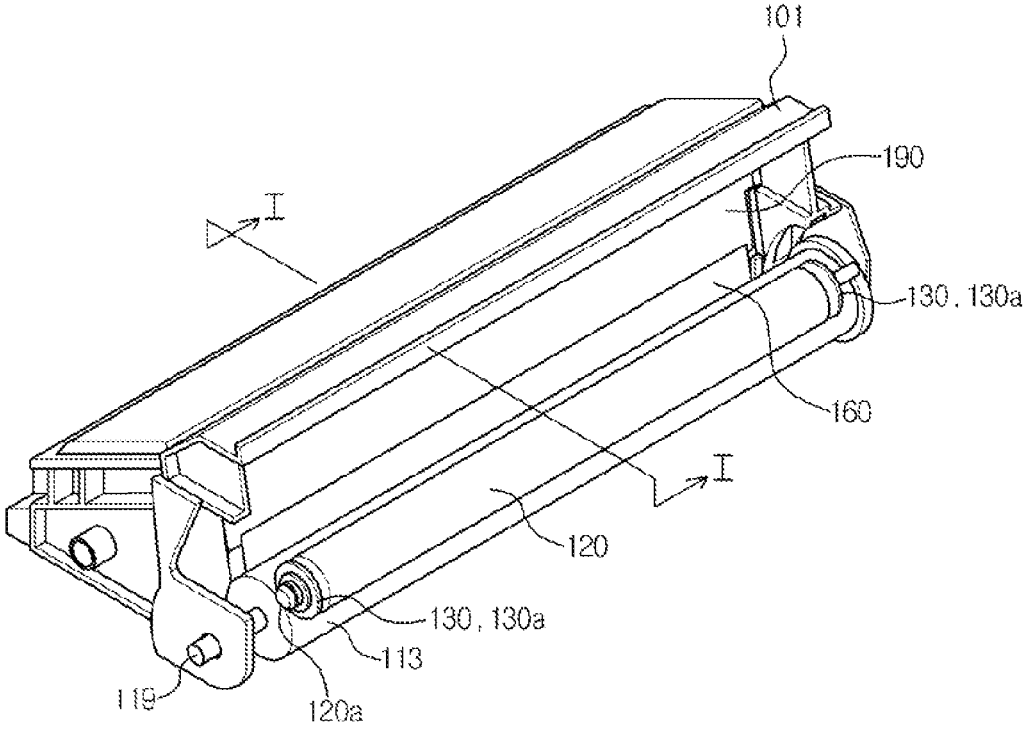
FIG. 2 is an enlarged perspective view illustrating main elements of the portion 'A' of FIG. 1.
Figure 3:
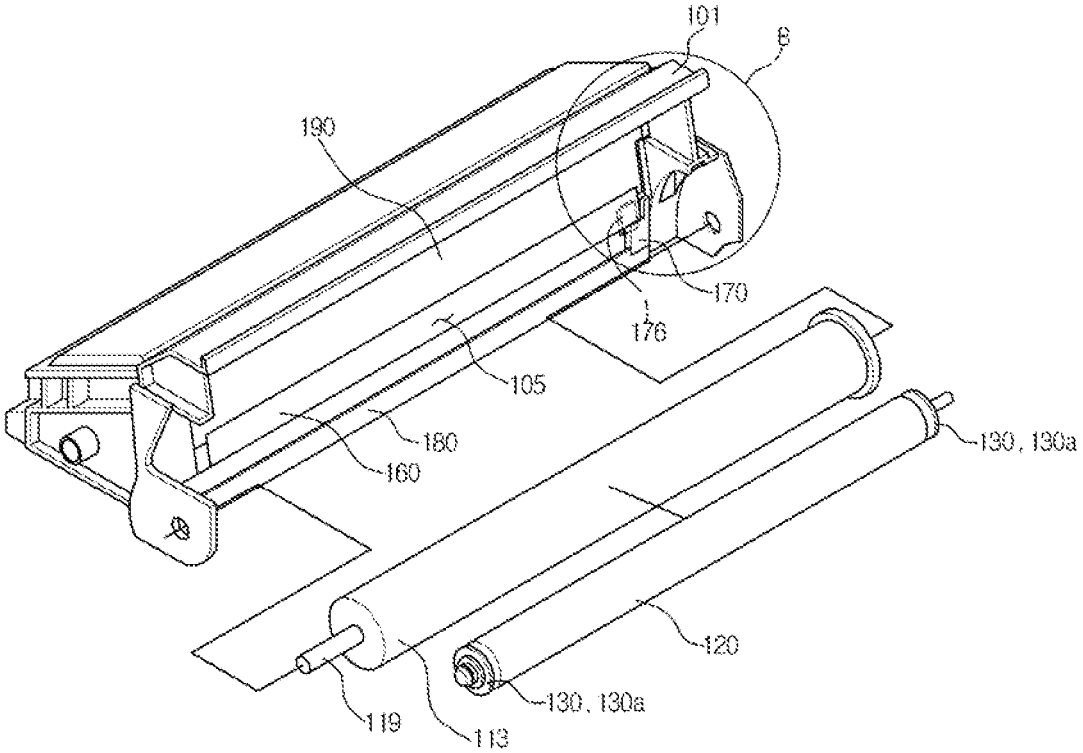
FIG. 3 is an exploded perspective view of elements illustrated in FIG. 2.
Figure 4:
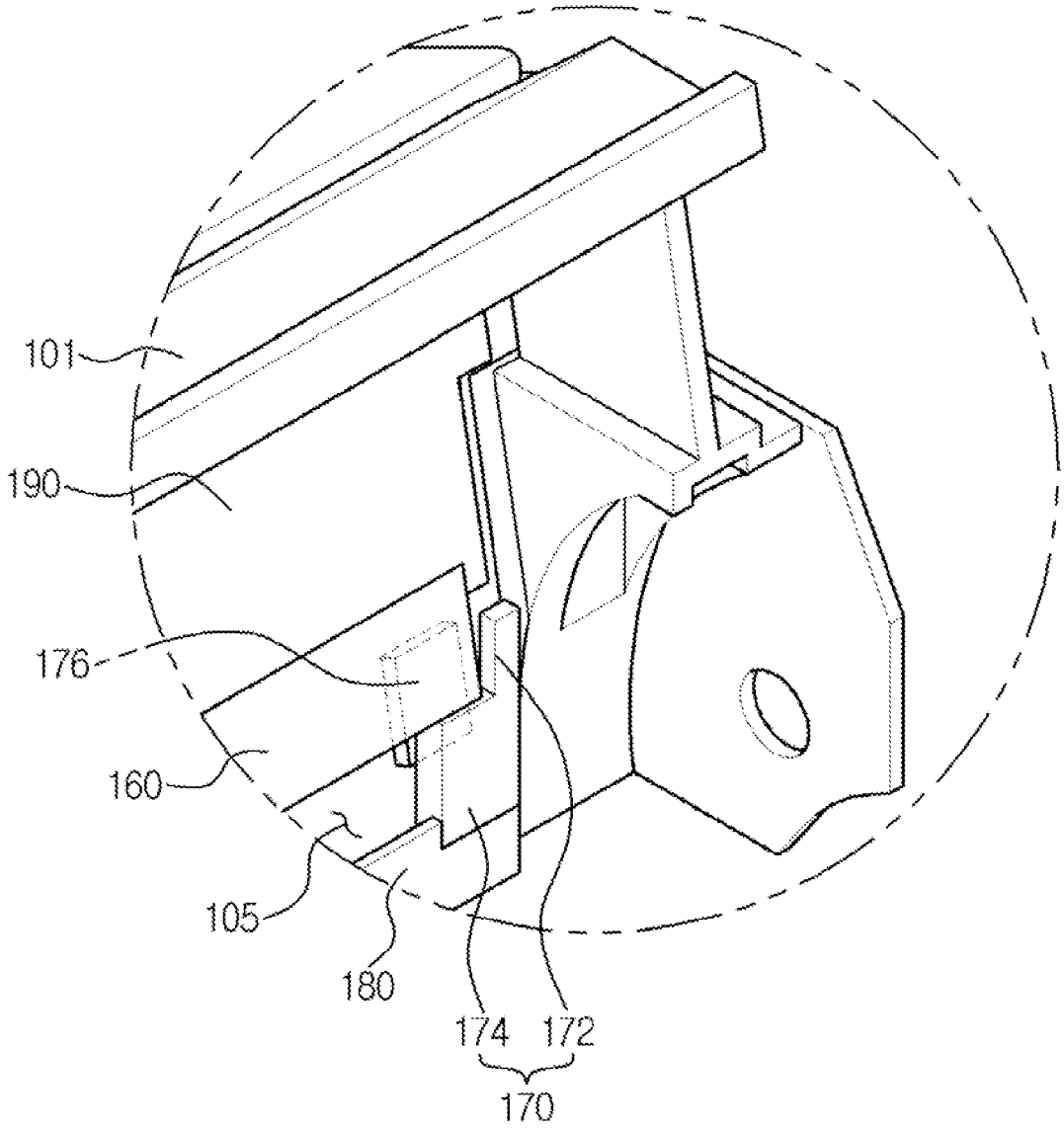
FIG. 4 is an enlarged perspective view illustrating the portion 'B' of FIG. 3.
Figure 5:
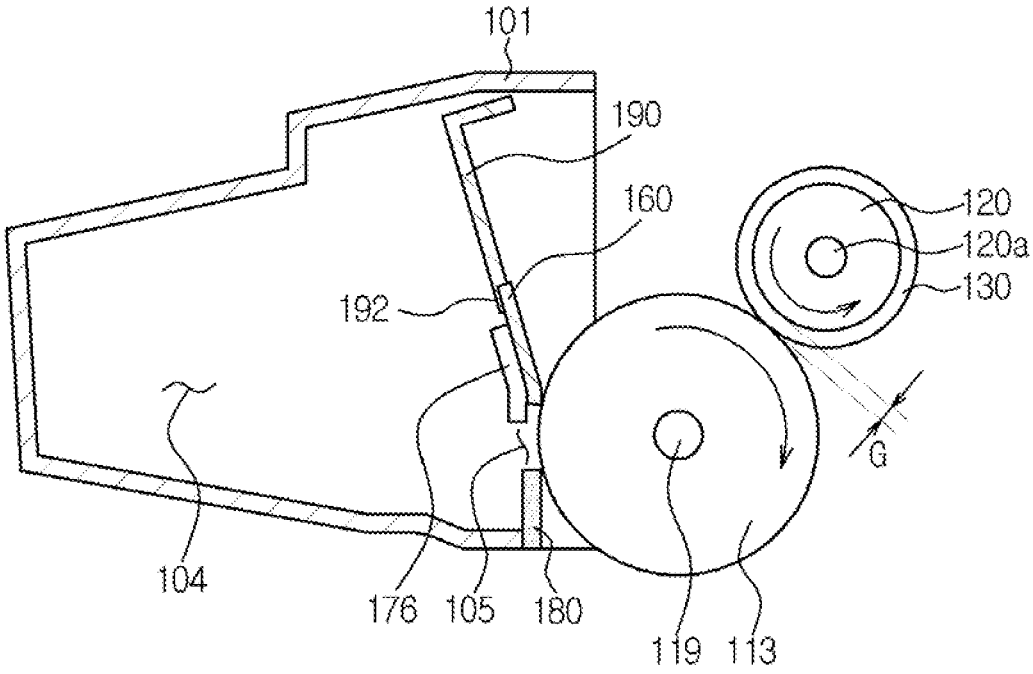
FIG. 5 is a sectional view taken along the line I-I of FIG. 2 in relation to a non-contact type developing method.
Figure 6:
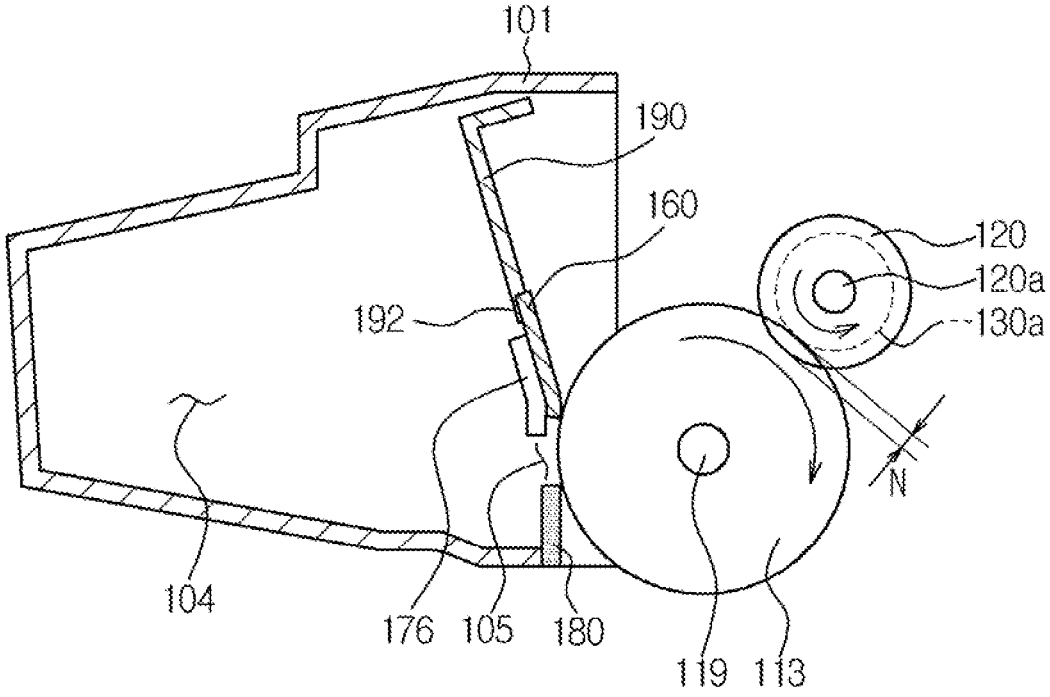
FIG. 6 is a sectional view taken along the line I-I of FIG. 2 in relation to a contact type developing method.

FIG. 2 is an enlarged perspective view illustrating main elements of the portion 'A' of FIG. 1, FIG. 3 is an exploded perspective view of elements illustrated in FIG. 2, FIG. 4 is an enlarged perspective view illustrating the portion 'B' of FIG. 3, FIG. 5 is a sectional view taken along the line I-I of FIG. 2 in relation to a non-contact type developing method, and FIG. 6 is a sectional view taken along the line I-I of FIG. 2 in relation to a contact type developing method.

As illustrated in FIGS. 2 to 6, a cleaning member 160 is provided in the housing 101. The cleaning member 160 serves to remove various foreign substances and the developer remaining on the surface of the photoconductor 113. The cleaning member 160 has an approximately rectangular blade shape and extends lengthwise in an axial direction of the rotating shaft 120*a* that supports the developer delivery member 120.

The cleaning member 160 is coupled to the housing 101 via a bracket 190. The bracket 190 has a coupling portion 192 to secure the cleaning member 160 so as to assist in coupling the cleaning member 160 inside the housing 101. As the cleaning member 160 is secured by the coupling portion 192 of the bracket 190, the cleaning member 160 is coupled to the housing 101 via the bracket 190 so as to come into contact with the outer peripheral surface of the photoconductor 113.

The cleaning member 160 is formed of an elastic material, such as rubber, which allows the cleaning member 160 to always come into contact with the outer peripheral surface of the photoconductor 113 by elasticity thereof.

A sealing member 170 is provided within the housing 101 and serves to prevent the developer removed by the cleaning member 160 from leaking from either side of the cleaning member 160. The sealing member 170 includes a fixing portion 172 fixed to the housing 101 and a contact portion 174 stepped from the fixing portion 172 so as to come into contact with either end of the cleaning member 160. The fixing portion 172 is provided with an adhesive member (not shown) such as a double-sided tape to fix the sealing member 170 to the housing 101. The sealing member 170, which is kept in contact with ends of the cleaning member 160, may act to absorb the developer once the developer has been removed from the surface of the photoconductor 113 and moved to either end of the cleaning member 160, or may act to move the developer to a waste developer storage chamber 104.

An auxiliary sealing member 176 may also be coupled to one surface of the cleaning member 160. The auxiliary sealing member 176 is arranged to come into contact with the sealing member 170, so as to absorb the developer moved to either end of the cleaning member 160 or to move the developer to the waste developer storage chamber 104 in cooperation with the sealing member 170.

The sealing member 170 and the auxiliary sealing member 176 may come into close contact with the photoconductor 113 by elasticity thereof and may be formed of a material suitable to absorb fine particles such as waste developer. For example, sponge or compressed felt to which Teflon has been added may be used.

A film member 180 is provided below the cleaning member 160. The film member 180 is arranged to come into contact with the outer peripheral surface of the photoconductor 113 and serves to guide the developer and foreign substances removed by the cleaning member 160 into the waste developer storage chamber 104. Both ends of the film member 180 come into contact with the sealing member 170 to prevent the developer and foreign substances removed by the cleaning member 160 from leaking from the housing 101.

The film member 180 may be a polyethyleneterephthalate (PET) film having elasticity.

The waste developer storage chamber 104 occupies a side region of the housing 101 and stores the developer removed from the surface of the photoconductor 113 by the cleaning member 160. The waste developer storage chamber 104 and the developing chamber 103 are partitioned from each other by the bracket 190, the cleaning member 160 is coupled to one end of the bracket 190, the sealing member 170 is in contact with the ends of the cleaning member 160, the film member 180 is provided at a lower end of the cleaning member 160 and the photoconductor 113, and the outer peripheral surface of the photoconductor 113 comes into contact with the cleaning member 160 and the film member 180. Accordingly, the waste developer storage chamber 104 prevents the developer and foreign substances introduced therein from leaking to the outside of the housing 101 or into the developing chamber 103.

In some embodiments, space maintaining members 130 may be rotatably installed on the rotating shaft 120*a* of the developer delivery member 120 such that an outer peripheral surface of each space maintaining member 130 comes into contact with the photoconductor 113. The space maintaining members 130 are engaged with the photoconductor 113 so as to be rotated during rotation of the photoconductor 113. In some embodiments, space maintaining members 130*a* may be arranged at opposite ends of the rotating shaft 120*a* with the developer delivery member 120 interposed therebetween. In both the above cases, a distance between the space maintaining members 130 or 130*a* arranged respectively at opposite ends of the rotating shaft 120*a* is greater than a width of the paper, which prevents the paper from interfering with the space maintaining members 130 or 130*a* when the paper is delivered to the photoconductor 113.

As illustrated in FIG. 5, in the case of a non-contact type developing method in which the developer delivery member 120 does not come into contact with the photoconductor 113 and defines a developing gap G with the photoconductor 113 to feed developer, the space maintaining members 130 have an outer diameter greater than an outer diameter of the developer delivery member 120. As such, the space maintaining members 130 serve to maintain a constant developing gap G between the developer delivery member 120 and the photoconductor 113.

As illustrated in FIG. 6, in the case of a contact type developing method in which the developer delivery member 120 comes into contact with the photoconductor 113 to define a developing nip N with the photoconductor 113 to feed developer, the space maintaining members 130*a* have an outer diameter less than an outer diameter of the developer delivery member 120. As such, the space maintaining members 130*a* serve to maintain a constant developing nip N between the developer delivery member 120 and the photoconductor 113.

The space maintaining members 130 or 130*a* to maintain a constant developing gap G or a constant developing nip N are arranged so as not to be contaminated by the developer or other foreign substances removed by the cleaning member 160.

Figure 7:
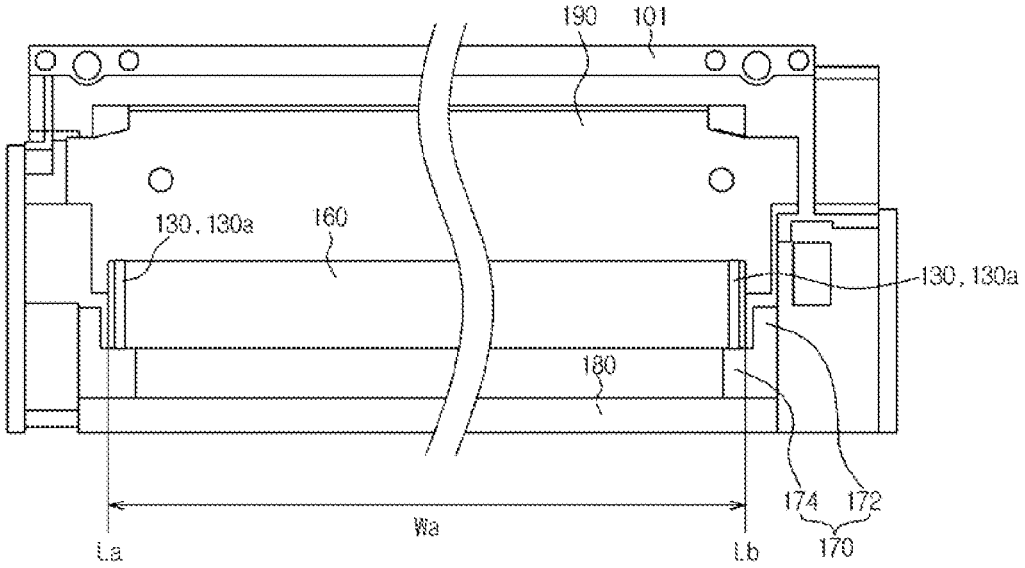
FIG. 7 is a view illustrating a positional relationship between a cleaning member and a space maintaining member.
Figure 8:
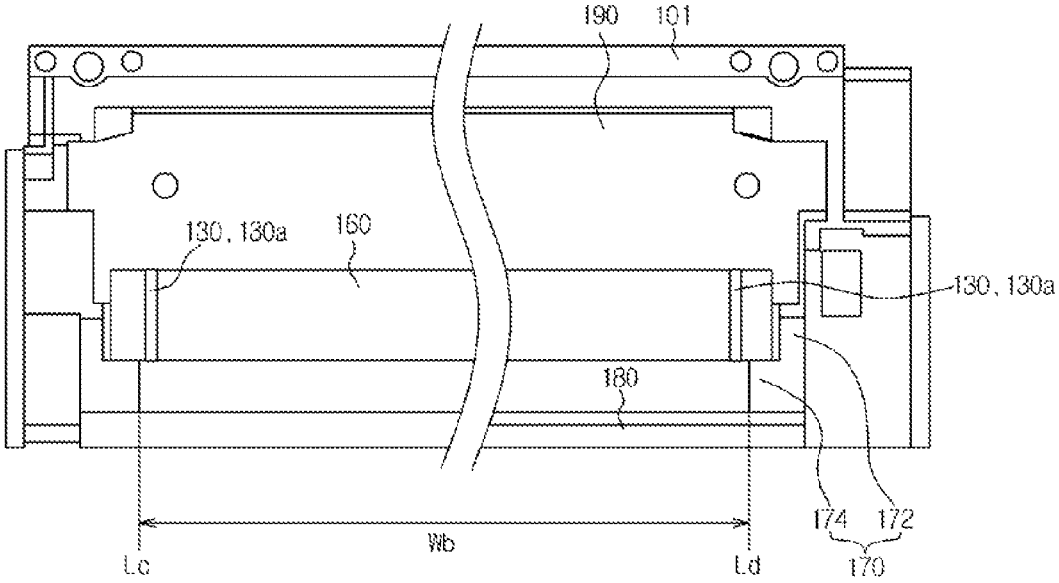
FIG. 8 is a view illustrating a positional relationship between a sealing member and a space maintaining member.

FIG. 7 is a view illustrating a positional relationship between the cleaning member 160 and the space maintaining member 130 or 130*a*, and FIG. 8 is a view illustrating a positional relationship between the sealing member 170 and the space maintaining member 130 or 130*a*. In FIGS. 7 and 8, illustration of the photoconductor and the developer delivery member is omitted.

As illustrated in FIG. 7, the space maintaining members 130 or 130*a* are inwardly spaced apart from both ends of the cleaning member 160 so as not to overlap with imaginary lines La and Lb extending from the respective ends of the cleaning member 160 in a direction perpendicular to a center rotation axis of the photoconductor 113.

A width Wa between the imaginary lines La and Lb extending from both ends of the cleaning member 160 defines an area in which the cleaning member 160 comes into contact with the photoconductor 113 to enable removal of the developer and foreign substances from the surface of the photoconductor 113. As the surface of the photoconductor 113 located in the width Wa between the imaginary lines La and Lb is repeatedly cleaned while continuously coming into contact with the cleaning member 160, the space maintaining members 130 or 130*a*, which are located inside the imaginary lines La and Lb so as not to overlap with the imaginary lines La and Lb, are free from contamination by the developer or foreign substances.

Explaining the above described configuration in more detail with reference to FIG. 5, the photoconductor 113 receives the developer from the developer delivery member 120 while being rotated in a direction designated by the arrow and successively, transfers the developer to the paper delivered to the photoconductor 113. The developer, which remains on the surface of the photoconductor 113 after transfer to the paper, is removed by the cleaning member 160, thereby being introduced into the waste developer storage chamber 104 or absorbed by the sealing member 170. Since the space maintaining members 130 always come into contact with the surface of the photoconductor 113 on which no developer or other foreign substances remain by operation of the cleaning member 160, it is possible to prevent the space maintaining members 130 from being contaminated by the developer or foreign substances.

Accordingly, as a result of arranging the space maintaining members 130 or 130*a* inside both ends of the cleaning member 160 so as not to overlap with the imaginary lines La and Lb, it is possible to prevent the developer or foreign substances from accumulating on the surface of the space maintaining members 130 or 130*a* and thus, it is also possible to prevent the developer or foreign substances from being adhered to the surface of the space maintaining members 130 or 130*a* by contact pressure between the space maintaining members 130 or 130*a* and the photoconductor 113. Consequently, it is possible to prevent a distance between the photoconductor 113 and the developer delivery member 120 from becoming irregular due to developer or foreign substances becoming present on the space maintaining members 130 or 130*a*.

A distance between each space maintaining member 130 or 130*a* and the corresponding imaginary line La or Lb may be 20 mm or less. As described above, the distance between the pair of space maintaining members 130 or 130*a* must be greater than the width of the paper. Thus, if the distance between the space maintaining member 130 or 130*a* and the corresponding imaginary line La or Lb is excessively great, it may be difficult to achieve the greater distance between the pair of space maintaining members 130 or 130*a* than the width of the paper because this needs to excessively increase a width of the entire housing 101 containing the photoconductor 113 and the developer delivery member 120.

As illustrated in FIG. 8, each space maintaining member 130 or 130*a* may be inwardly spaced apart from one end of the contact portion 174 of the sealing member 170 so as not to overlap with an imaginary line Lc or Ld extending from the end of the contact portion 174 in a direction perpendicular to the center rotation axis of the photoconductor 113.

The cleaning member 160 is adapted to scrape the developer and foreign substances remaining on the surface of the photoconductor 113 while coming into contact with the surface of the rotating photoconductor 113. Although most of the developer and foreign substances scraped by the cleaning member 160 are separated from the surface of the photoconductor 113 and introduced into the waste developer storage chamber 104, a part of the developer and foreign substances may move toward a rotating shaft 119 which rotatably supports the photoconductor 113 during rotation of the photoconductor 113, rather than being introduced into the waste developer storage chamber 104. The developer and foreign substances moved toward the rotating shaft 119 are collected at both ends of the cleaning member 160, thereby being absorbed by the sealing member 170 or being guided into the waste developer storage chamber 104.

The sealing member 170 has a fixed volume although it is formed of a material suitable to absorb fine particles such as developer and thus, absorbs only a limited quantity of developer. If the sealing member 170 is saturated with the developer and foreign substances supplied thereto by the cleaning member 160, a part of the developer and foreign substances, not absorbed by the sealing member 170, remain on the surface of the photoconductor 113 in contact with the sealing member 170.

The surface of the photoconductor 113 located in a width Wb between the imaginary line Lc and the imaginary line Ld is free from contamination by the developer and foreign substances not absorbed by the sealing member 170, or is repeatedly cleaned while continuously coming into contact with the cleaning member 160 even if it is partially contaminated. Thus, the space maintaining members 130 or 130*a* arranged between the imaginary lines Lc and Ld so as not to overlap with the imaginary lines Lc and Ld are free from contamination by the developer and foreign substances.

The width Wb between the imaginary line Lc and the imaginary line Ld is equal to a width of an entrance 105 of the waste developer storage chamber 104. This is because the entrance 105 is defined by the cleaning member 160, the sealing members 170 in contact with both ends of the cleaning member 160 and the film member 180 provided at the lower end of the cleaning member 160 and thus, the width of the entrance 105 is equal to a distance between the contact portions 174 of the sealing members 170.

As is apparent from the above description, the embodiment of the present inventive concept provides an image forming apparatus in which a developer delivery member is adapted to feed developer to a photoconductor at a predetermined position with respect to the photoconductor, which may prevent printing defects.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device comprising:

a photoconductor;

a developer delivery member to deliver and feed developer to the photoconductor;

a cleaning member to remove developer and foreign substances remaining on a surface of the photoconductor while coming into contact with the photoconductor;

sealing members respectively located at both ends of the cleaning member to prevent leakage of the developer, each of the sealing members including a contact portion to come into contact with respective ends of the cleaning member; and space maintaining members disposed on the developer delivery member and arranged to directly or indirectly come into contact with the photoconductor so as to maintain a constant developing gap or developing nip between the photoconductor and the developer delivery member, the space maintaining members being located between both ends of the cleaning member and outside a region defined by the respective contact portions of the sealing members.

2. The developing device according to claim 1, further comprising:

auxiliary sealing members coupled to a rear surface of the cleaning member and arranged to come into contact with the respective sealing members so as to prevent leakage of the developer in cooperation with the sealing members.

3. The developing device according to claim 2, wherein the space maintaining members are located between the auxiliary sealing members.

4. The developing device according to claim 1, wherein:

the space maintaining members are provided at the outer side of both ends of the developer delivery member; and a distance between the space maintaining members is greater than a width of paper delivered to the photoconductor.

5. The developing device according to claim 1, wherein each of the space maintaining members is spaced apart from one end of the cleaning member by a distance of about 20 mm or less.

6. An image forming apparatus comprising:

a main body;

a housing mounted in the main body;

a photoconductor rotatably coupled to the housing;

a developer delivery member arranged near the photoconductor to deliver developer to the photoconductor;

a cleaning blade arranged to come into contact with a surface of the photoconductor to remove the developer remaining on the surface of the photoconductor;

sealing members arranged to come into contact with both ends of the cleaning blade to prevent leakage of the developer, each of the sealing members including a contact portion to come into contact with respective ends of the cleaning member; and a space maintaining member disposed on the developer delivery member and arranged within an area to be cleaned by the cleaning blade and located outside a region defined by the respective contact portions of the sealing members and serving to maintain a constant developing gap or developing nip between the photoconductor and the developer delivery member.

7. The image forming apparatus according to claim 6, further comprising:

a waste developer storage chamber in which the developer removed from the surface of the photoconductor is stored; and a film member arranged below the cleaning blade to define an entrance of the waste developer storage chamber along with the cleaning blade and the sealing members.

8. A developing device usable with an image forming apparatus, the developing device comprising:

a photoconductor to receive developer;

a cleaning member extending along a length of the photoconductor and to remove remaining developer from the photoconductor;

sealing members disposed at each end of the cleaning member to absorb developer remaining at ends of the cleaning member and to prevent leakage of the developer past the ends of the cleaning member, each of the sealing members including a contact portion to come into contact with respective ends of the cleaning member; and a developer delivery member to deliver the developer to the photoconductor, the developer delivery member including space maintaining members disposed at each end thereof to contact respective ends of the photoconductor to maintain a space or nip between the developer, delivery member and the photoconductor, the space maintaining members being disposed at positions inside a region defined by ends of the cleaning member and being located outside a region defined by the respective contact portions of the sealing members.

9. The developing device of claim 8, wherein the sealing members overlap a portion of the ends of the cleaning members.

10. The developing device of claim 8, further comprising:

a waste developer storage chamber in which the developer removed from the surface of the photoconductor is stored; and a film member disposed below the cleaning blade to define an entrance of the waste developer storage chamber along with the cleaning blade and the sealing members.

* * * * *